US007043766B1

(12) United States Patent
Foreman et al.

(10) Patent No.: US 7,043,766 B1
(45) Date of Patent: May 16, 2006

(54) GARMENT FOR COOLING AND INSULATING

(75) Inventors: Louis J. Foreman, Charlotte, NC (US); Ronald M. Sytz, Gastonia, NC (US)

(73) Assignee: Enventys, LLC, Charlotte, NC (US)

( * ) Notice: Subject to any disclaimer, the term of this patent is extended or adjusted under 35 U.S.C. 154(b) by 324 days.

(21) Appl. No.: 10/653,311

(22) Filed: Sep. 2, 2003

Related U.S. Application Data

(60) Provisional application No. 60/407,810, filed on Sep. 2, 2002.

(51) Int. Cl.
*A41B 9/00* (2006.01)

(52) U.S. Cl. ..... 2/81; 2/69; 2/DIG. 1

(58) Field of Classification Search ..... 66/202, 66/169 R, 200, 196, 197, 170, 171; 2/455, 2/456, 457, 458, 91–97, DIG. 1
See application file for complete search history.

(56) References Cited

U.S. PATENT DOCUMENTS 2,289,302 A * 7/1942 Bradshaw ..... 66/195
3,063,271 A * 11/1962 Faust et al. ..... 66/82 R
3,971,234 A * 7/1976 Taylor ..... 66/200
4,451,934 A * 6/1984 Gioello ..... 2/113
5,150,476 A * 9/1992 Statham et al. ..... 2/93
5,274,849 A * 1/1994 Grilliot et al. ..... 2/81
5,515,543 A * 5/1996 Gioello ..... 2/69
5,713,062 A 1/1998 Goodman et al.
5,833,321 A 11/1998 Kim et al.
5,851,930 A 12/1998 Bessey et al.
5,882,322 A 3/1999 Kim et al.
5,896,680 A 4/1999 Kim et al.
5,972,477 A 10/1999 Kim et al.
6,007,898 A 12/1999 Kim et al.
6,263,511 B1 * 7/2001 Moretti ..... 2/97
6,804,978 B1 * 10/2004 Kost ..... 66/195

* cited by examiner

*Primary Examiner*—Danny Worrell
(74) *Attorney, Agent, or Firm*—Tillman Ivsan, PLLC; Chad D. Tillman

(57) ABSTRACT

A garment has indentations forming air channels next to the body of the wearer, and includes: a first yarn preferably being a single monofilament of polyester; a second yarn preferably formed from staple or filament yarn, whether manmade or of natural fiber, such as polyester, cotton, rayon, nylon, acrylic; and a third yarn being an elastomeric yarn that provides proper stretch and recovery to enable a proper fit of the garment next to the body of the wearer. The first yarn preferably is a single monofilament of polyester. The second yarn preferably provides softness for comfort. The third yarn preferably is spandex. For certain applications of the garment, the second yarn is formed from staples of synthetic materials such as Kevlar, Nomex, or Spectra in order to provide fire retardence, cut resistance, and/or impact/ballistic protection. The indentations may be formed only in selected areas of the garment in accordance therewith.

20 Claims, 11 Drawing Sheets

GARMENT FOR COOLING AND INSULATING

CROSS-REFERENCE TO RELATED APPLICATION

The present application is a nonprovisional of and claims the benefit under 35 U.S.C. § 119(e) to Foreman et al. U.S. provisional patent application Ser. No. 60/407,810 filed Sep. 2, 2002, which is hereby incorporated by reference.

FIELD OF THE PRESENT INVENTION

The present invention generally relates to clothing and, in particular, to a garment for improved cooling and/or insulating of the wearer, especially when used as an undergarment.

BACKGROUND OF THE PRESENT INVENTION

Current garments promote cooling by wicking of perspiration away from the body. The perspiration then evaporates from the garment. It is desirable to provide for a layer of air between the garment and the body such that the perspiration evaporates from the body itself, thereby providing improved cooling.

SUMMARY OF THE PRESENT INVENTION

Briefly described, the present invention relates to a garment having indentations forming air channels for improved cooling of the body of the wearer of the garment.

In one aspect of the invention, the garment includes: (a) a first yarn preferably comprising a single monofilament of polyester; (b) a second yarn; and (c) a third yarn comprising an elastomeric yarn. The first yarn preferably consists of a single monofilament of polyester. The second yarn preferably is formed from staples of polyester or cotton for comfort, and the third yarn preferably comprises Spandex whereby elasticity is provided to the garment for comfort form fitting of the garment to the body of the wearer.

In additional aspects of the invention: the first yarn provides sufficient rigidity to define and maintain the shape of the indentations in and after the forming process and/or sufficient rigidity that a force of impact is absorbed upon compression of the indentations; the second yarn is formed from staples of fire retardant Kevlar or the like; and the indentations are uniform or varying in size and shape.

In another aspect of the invention, the garment is worn as an undergarment and the invention further includes an outer garment. In aspect of the invention having an outer garment: the outer garment comprises protective equipment or protective gear for athletic and/or sporting use; and the outer garment includes a vent.

When a vent is provided, the vent preferably is adjustable for selectively is admitting airflow to the undergarment. Furthermore, the vent preferably overlies indentations in the undergarment. In additional aspects: the outer garment is wind resistant or wind proof; the garment includes a port and further comprising a conduit connected to the port supplying cool air to the air channels of the undergarment.

BRIEF DESCRIPTION OF THE DRAWINGS

Further features and benefits of the present invention will be apparent from a detailed description of preferred embodiments thereof taken in conjunction with the following drawings, wherein similar elements are referred to with similar reference numbers, and wherein.

DETAILED DESCRIPTION OF PREFERRED EMBODIMENTS

Figure 1:
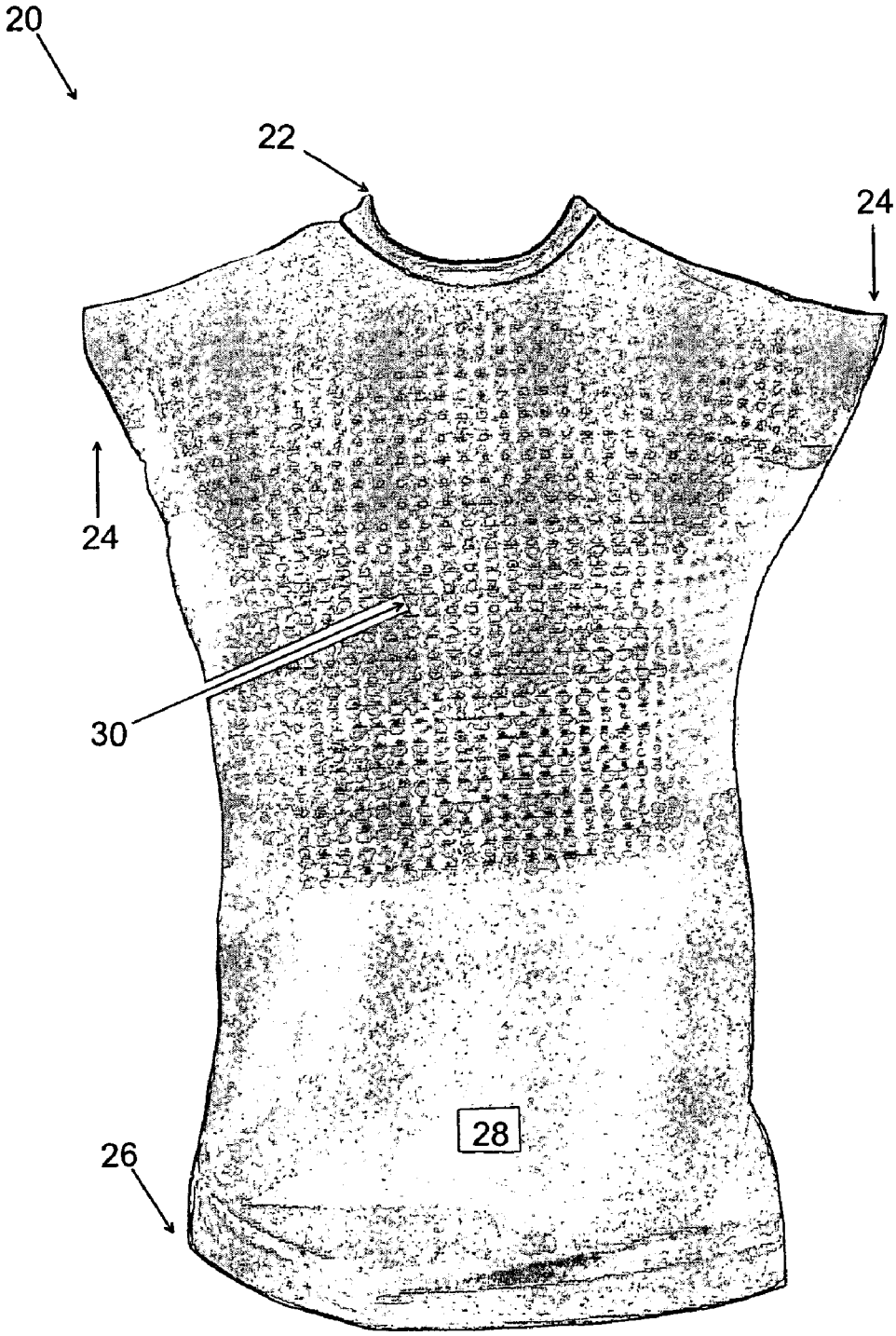
FIG. 1 illustrates an elevational view of the front of a shirt in accordance with the present invention.

As a preliminary matter, it will readily be understood by those persons skilled in the art that the present invention is susceptible of broad utility and application in view of the following detailed description of one or more preferred embodiments of the present invention. Many devices, methods, arrangements, embodiments, adaptations and the like of the present invention other than those embodiments herein expressly described, as well as many variations, modifications, and equivalents thereof, will be apparent from or reasonably suggested by the following detailed description of one or more embodiments of the present invention, without departing from the substance or scope of the present invention. Accordingly, while the present invention is described herein in detail in relation to one or more preferred embodiments, it is to be understood that this disclosure is illustrative and exemplary and is made merely for purposes of providing a full and enabling disclosure of the invention. The disclosure herein is not intended nor is to be construed to limit the present invention or otherwise to exclude any such other devices, methods, arrangements, embodiments, adaptations and the like, or variations, modifications, and equivalents.

The present invention comprises a garment having indentations formed therein such that channels of air are defined therebetween. The garment preferably is hydrophobic but air permeable. When the garment is worn, perspiration of the wearer evaporates within these channels. The evaporation occurs on the body of the wearer and, because heat is absorbed in the evaporation process, the evaporation directly absorbs heat from the body and cools the wearer. Wicking of the perspiration from the body by the garment itself, with subsequent evaporation from the exterior of the garment, cools the garment surface and thereby indirectly cools the body of the wearer; however, the evaporation in the wicking garment does not directly cool the body of the wearer.

The indentations may be uniform or may vary in size and shape in the garment. Preferably the indentations are domed shaped.

The garment is knit or woven from: a first yarn providing sufficient rigidity to define and maintain the shape of the indentations in and after the forming process; a second yarn preferably formed from staple or filament yarn, whether manmade or of natural fiber, such as polyester, cotton, rayon, nylon, acrylic, etc.; and a third yarn comprising an elastomeric yarn that provides proper stretch and recovery to enable a proper fit of the garment next to the body of the wearer. The first yarn preferably comprises a single monofilament of polyester. The second yarn preferably provides softness for comfort. The third yarn preferably is spandex and provides elasticity of the garment for comfort form fitting of the garment to the body of the wearer.

For certain applications of the garment, the second yarn could be formed from staples of synthetic materials such as Kevlar, Nomex, or Spectra to provide fire retardence, cut resistance, and/or impact/ballistic protection.

After knitting, the indentations are formed in the garment using methods disclosed, for example, in U.S. Pat. Nos. 5,713,062; 6,007,898; 5,833,321; 5,851,930; 5,896,680; 5,882,322; and 5,972,477, used for forming woven and knitted fabrics made entirely of monofilament yarns. Each of these patents is hereby incorporated by reference. However, the methods themselves as disclosed in these patents form no part of the present invention and are cited for purposes of provided an enabling disclosure of the invention herein.

Preferably the first yarn consists of a single monofilament, and is not formed from staples, such as a spun yarn. Because of the use of a monofilament as opposed to staples, the indentations formed in the garment do not have a tendency to flatten over time.

In certain applications of the present invention, the garment is used as an undergarment. For example, athletic equipment such as football or baseball protective gear (shoulder pads, etc.) can be worn over the undergarment, with the indentations forming air channels between the body of the wearer and the protective equipment. Airflow through the channels thereby provides cooling not otherwise realized. In law enforcement and the military, battle gear and combat outfits such as flight uniforms and life vests can be worn over the garment. Again, the indentations form air channels between the body of the wearer and the battle gear and combat outfits such that airflow therein provides cooling not otherwise realized.

In a feature of the present invention, only certain portions of the garment include the indentations providing the air channels. Thus, garments of the present invention have different patterns of indentations. For instance, for use of the garment as an undergarment to be worn under a bulletproof vest, the indentations preferably are formed in the garment only where the vest actually abuts the garment and presses against the body. For use of the garment under shoulder pads used for football, the indentations preferably are formed in the garment only where the shoulder pads actually abuts the garment and presses against the body. In another instance, the use of the garment itself without an outer garment includes an area of the bottom of the garment in which no indentations are formed. This area permits comfortable tucking of the "tail" of the garment into the pants or shorts of the wearer.

In another feature of the invention, the monofilament yarn provides sufficient rigidity that the indentations provide protection by absorbing some extent of the force of impacts. Furthermore, the degree of ballistic/impact protection needed in different areas of the garment may vary; preferably, the size and shape of the indentations in such area vary accordingly.

In another feature of the invention, the garment is used as an undergarment in conjunction with a windproof or wind resistant outer garment. In this use, the air channels provided by the indentations become insulation for retention of heat. The garment thus serves in part as a thermal insulator.

In yet another feature of the invention, the garment is used as an undergarment with a windproof or wind resistant outer garment having one or more vents, such as a zippered vent. Preferably, the vent overlies a portion of the indentations such that selected opening of the vent permits selected airflow through the air channels defined by the indentations.

For example, the invention includes a flight suit in combination with a garment as disclosed herein. The flight suit includes a zippered vent overlying a portion of the undergarment having the indentations forming air channels between the undergarment and the body of the wearer of the flight suit. In this case, the zipper serves a thermostatic function.

In another similar example, the invention includes a racecar suit (such as those worn by NASCAR drivers) in combination with a garment as disclosed herein. The racecar suit includes a port through which cooling air is pumped into the racecar suit. The port overlies a portion of the undergarment having the indentations forming air channels between the undergarment and the body of the wearer of the racecar suit.

A benefit of the garment of the present invention includes a therapeutic effect that is provided by the indentations. Specifically, the indentations on the skin provide a therapeutic effect similar to a Shiatsu Massage. In this respect, it has been shown in research that multiple small touch points provide a way to ease pressure and stress.

Figure 2:
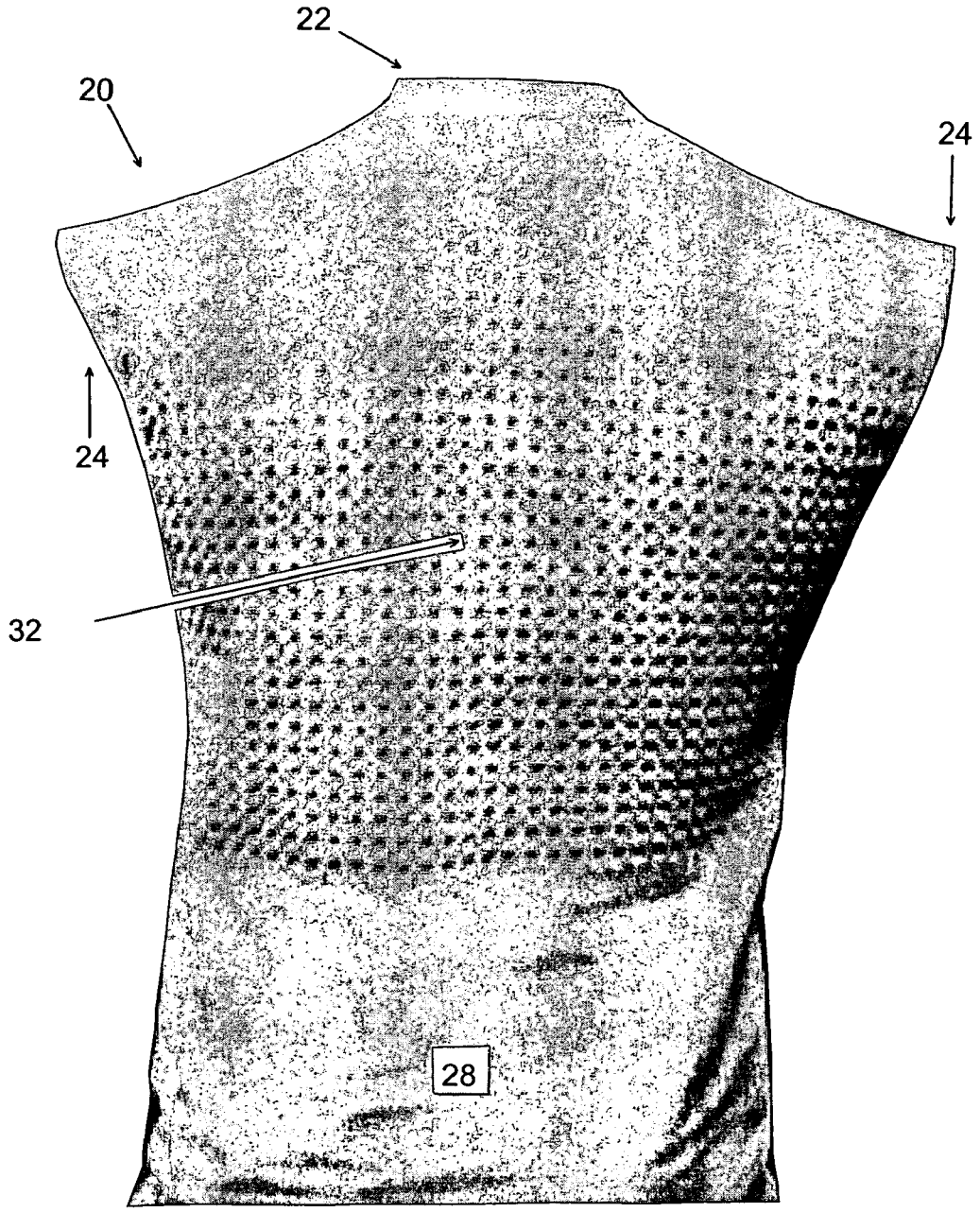
FIG. 2 illustrates an elevational view of the back of the shirt of FIG. 1.

A preferred embodiment of the present invention is shown in the drawings for illustration purposes. FIGS. 1–2 illustrate the front and back, respectively, of a shirt 20 of the present invention having a head opening 22, arm openings 24, and bottom opening 26. The shirt includes a tale 28.

The shirt includes an area 30 of indentations formed in the front and an area 32 of indentations formed in the back. Neither area 30,32 extends within the tale 28 of the shirt, whereby the shirt may readily be tucked into the pants or shorts of a wearer.

Figure 3:
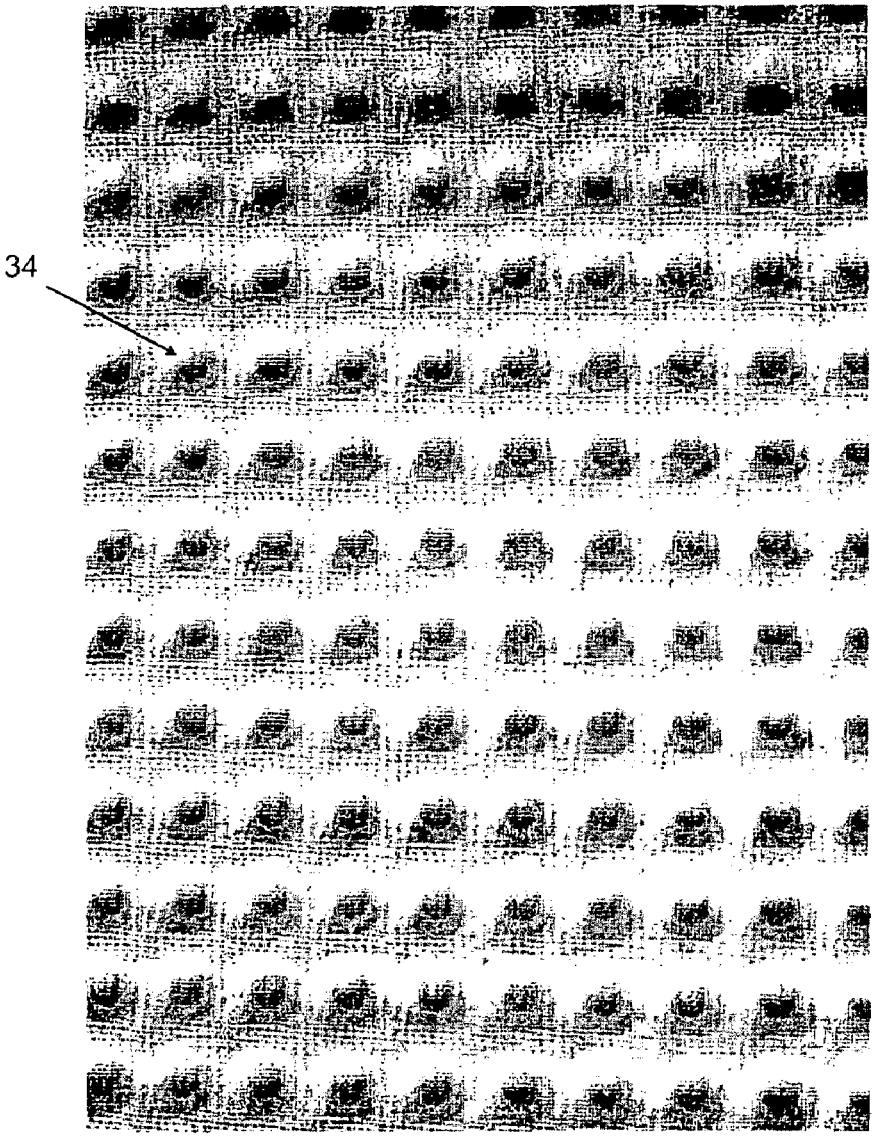
FIG. 3 illustrates a fist planar view of a portion of the shirt of FIG. 1 in an area of the indentations.
Figure 4:
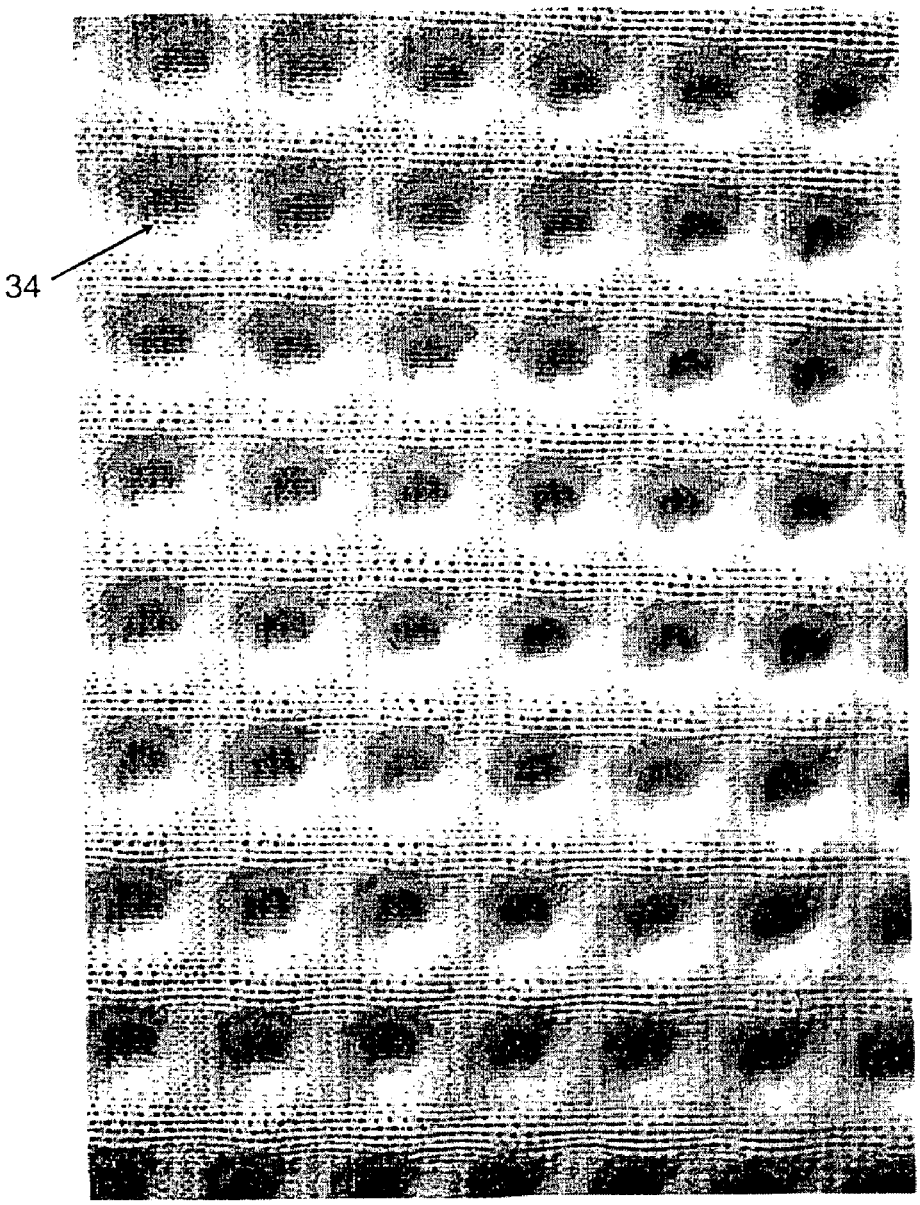
FIG. 4 illustrates a second, closer planar view of the portion of the shirt of FIG. 3.
Figure 5:
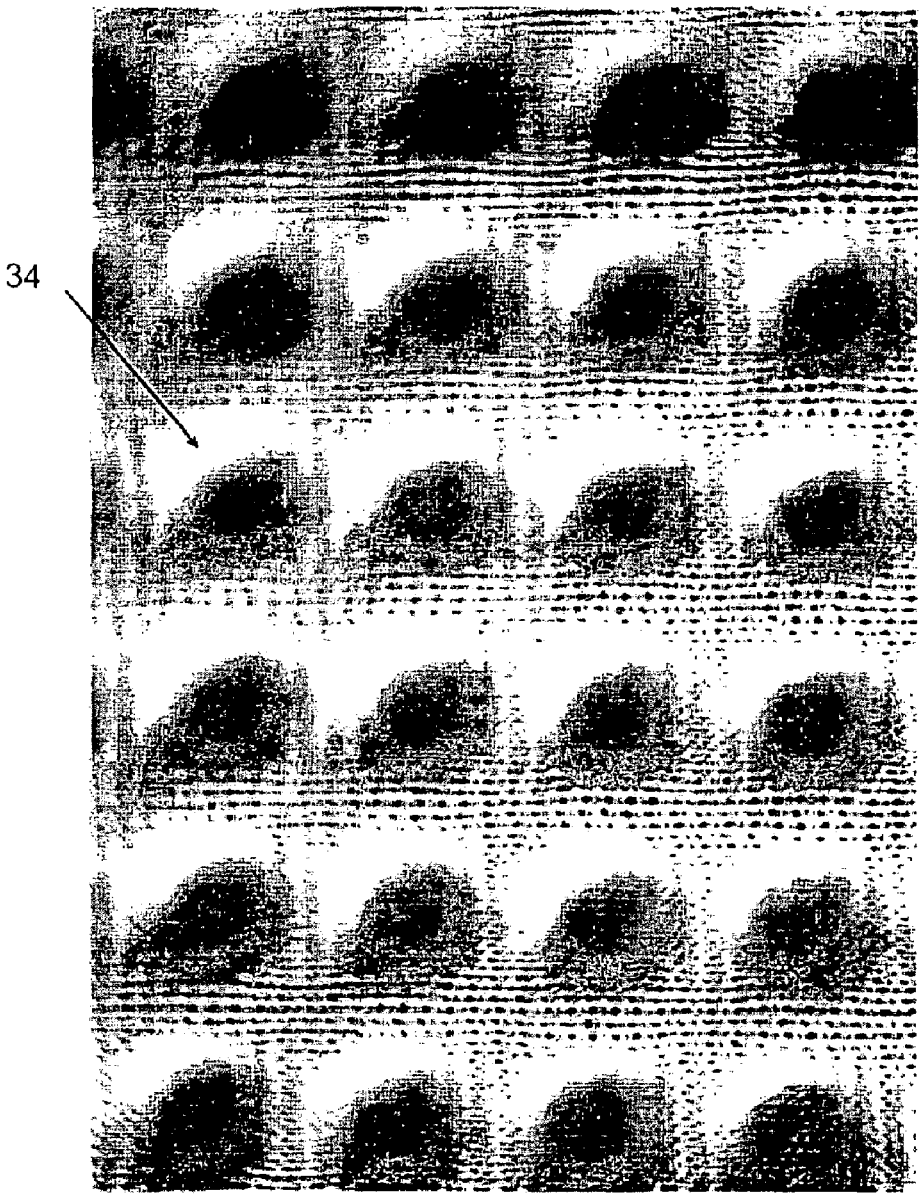
FIG. 5 illustrates yet a third, closer planar view of the portion of the shirt of FIG. 3.
Figure 6:
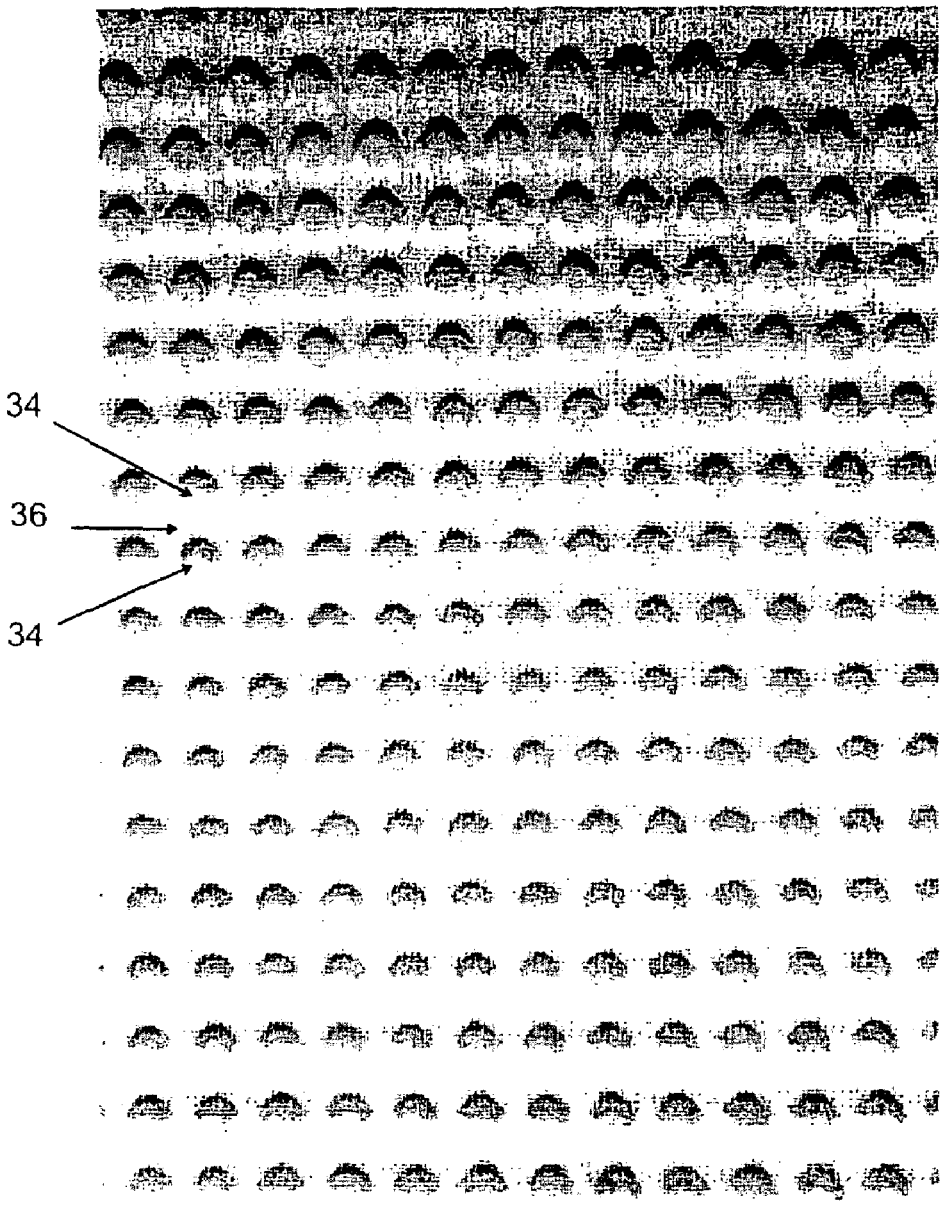
FIG. 6 illustrates a fist planar view of an underside portion of the shirt of FIG. 1 in an area of the indentations.
Figure 7:
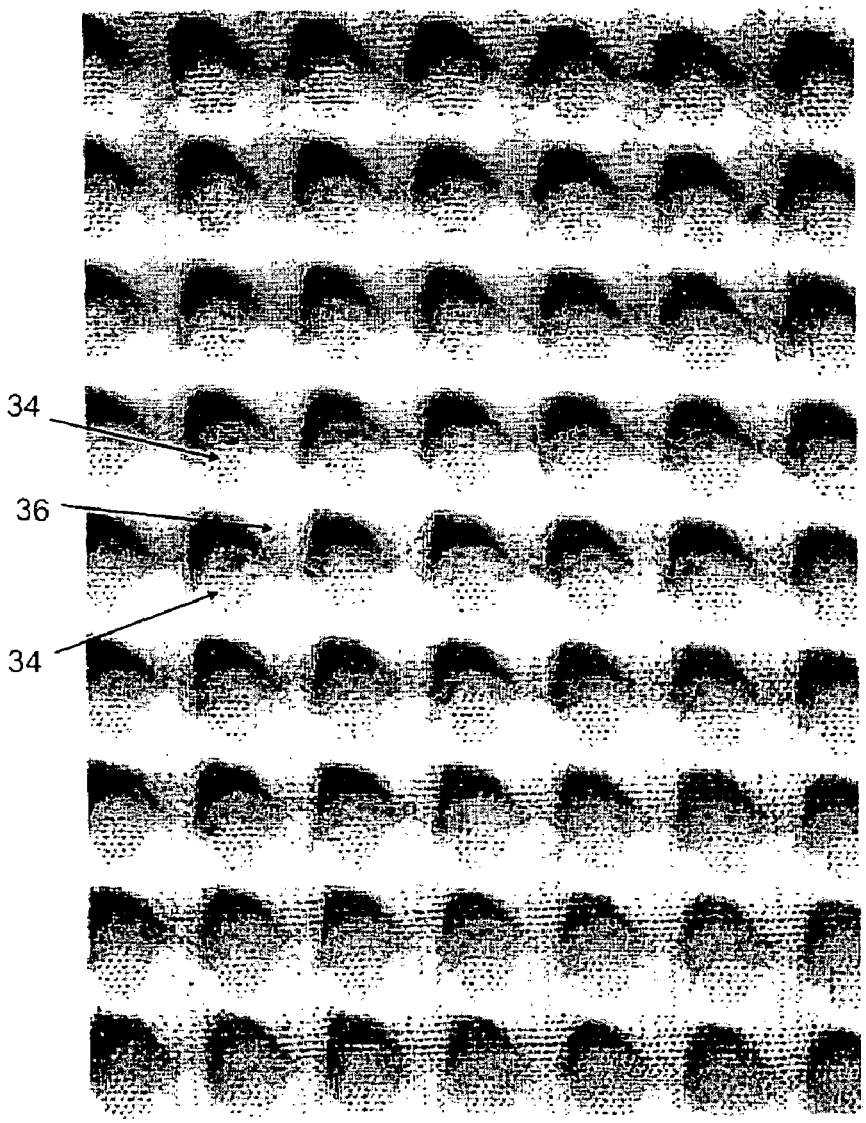
FIG. 7 illustrates a second, closer planar view of the portion of the shirt of FIG. 6.
Figure 8:
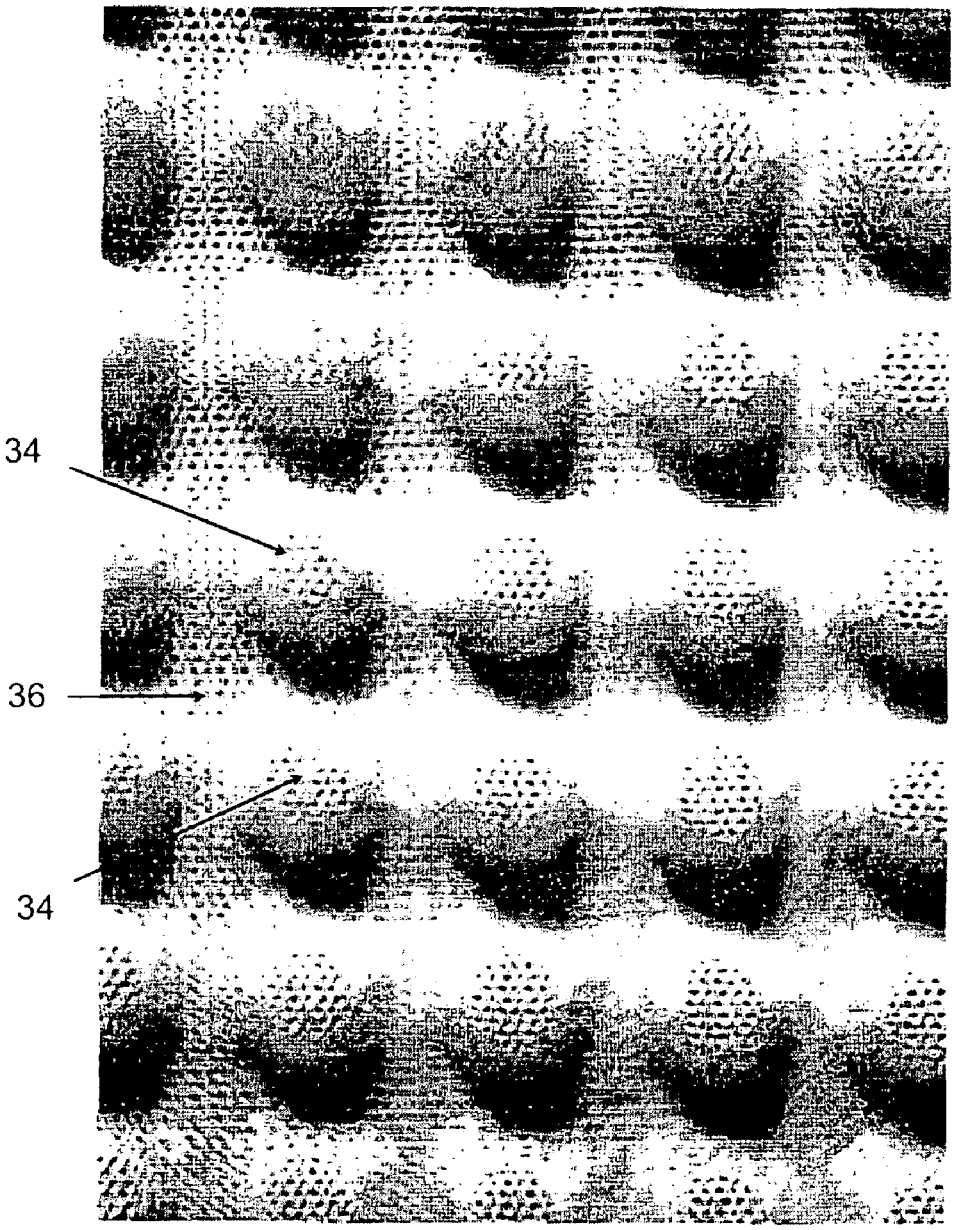
FIG. 8 illustrates yet a third, closer planar view of the portion of the shirt of FIG. 6.
Figure 9:
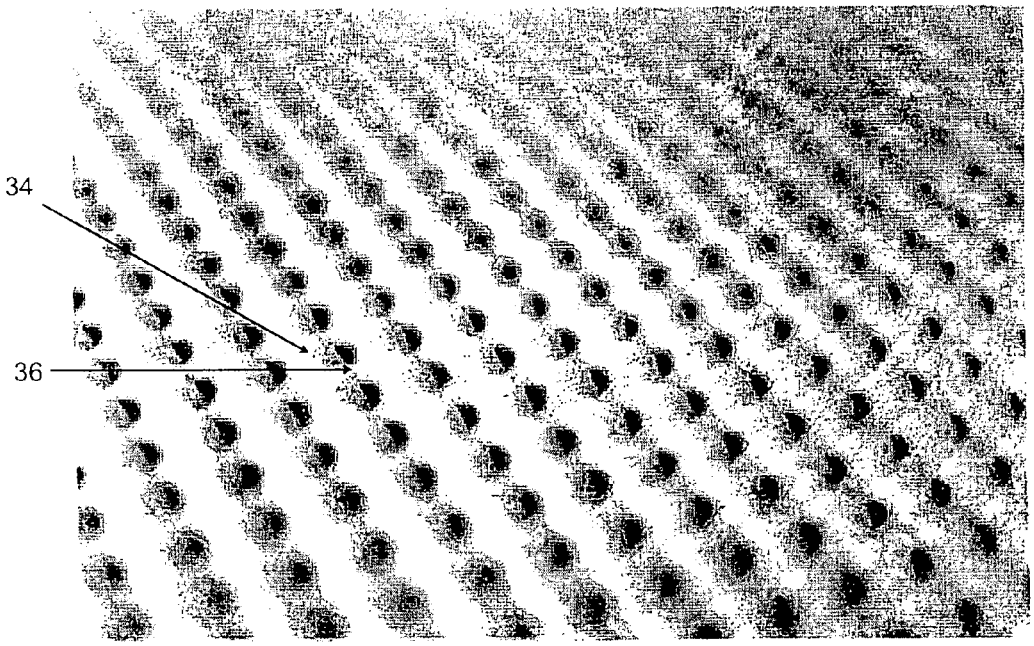
FIG. 9 illustrates a first perspective view of the portion of the shirt of FIG. 6.
Figure 10:
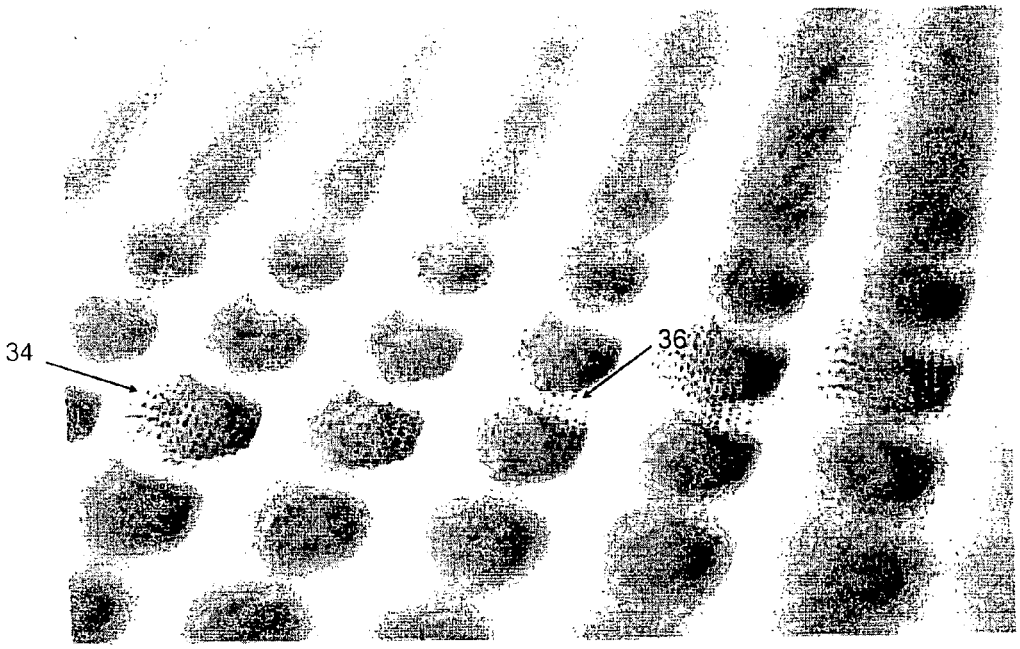
FIG. 10 illustrates a second, closer perspective view of the portion of the shirt of FIG. 6.
Figure 11:
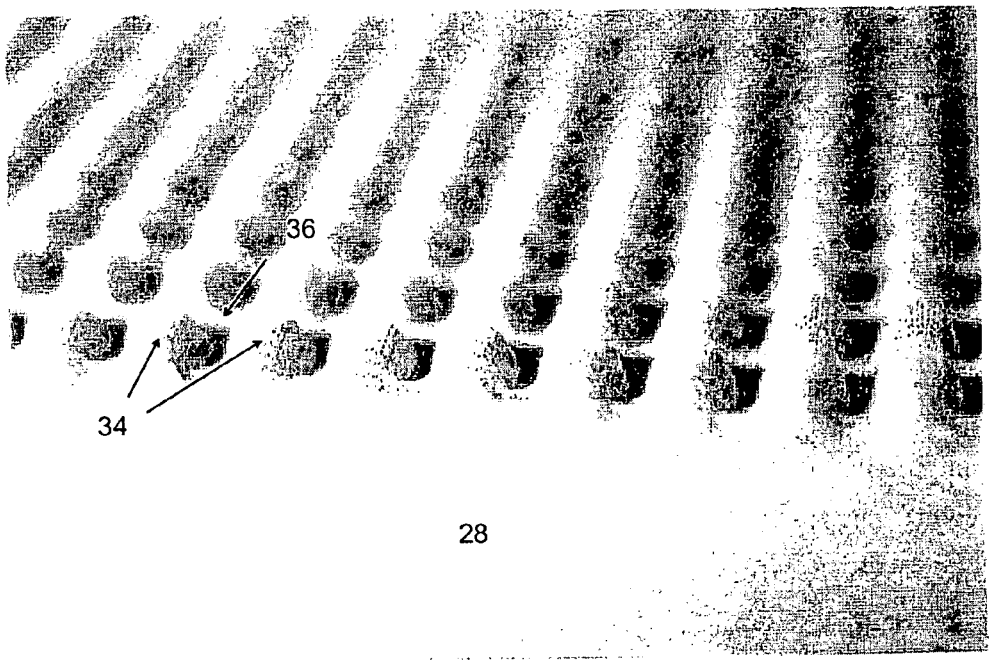
FIG. 11 illustrates a perspective view of an underside portion of the shirt of FIG. 1 in an area of the indentations adjoining the tale of the shirt.

FIGS. 3–5 illustrate the front and back portions of the shirt in the areas 30,32 having the indentations. FIGS. 6–8 illustrate the front and back portions of the inside of the shirt in the areas 30,32 having the indentations. As will be readily apparent from these figures, the indentations 34 themselves are domed-shaped, project inwardly, and define channels 36 therebetween for the passage of air.

In view of the foregoing detailed description of one or more preferred embodiments of the present invention, it readily will be understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Furthermore, any sequence(s) and/or temporal order of steps of various processes described and claimed herein are those considered to be the best mode contemplated for carrying out the present invention. It should also be understood that, although steps of various processes may be shown and described as being in a preferred sequence or temporal order, the steps of any such processes are not limited to being carried out in any particular sequence or order, absent a specific indication of such to achieve a particular intended result. In most cases, the steps of such processes may be carried out in various different sequences and orders, while still falling within the scope of the present inventions. Accordingly, while the present invention has been described herein in detail in relation to one or more preferred embodiments, it is to be understood that this disclosure is only illustrative and exemplary of the present invention and is made merely for purposes of providing a full and enabling disclosure of the invention. The foregoing disclosure herein is not intended nor is to be construed to limit the present invention or otherwise to exclude any such other devices, methods, arrangements, embodiments, adaptations and the like, or variations, modifications, and equivalents.

Thus, for example, while the first yarn has been described herein as a single monofilament of polyester, the first yarn may by any yarn such as a multifilament yarn in accordance with the broadest scope of the present invention so long as such yarn provides sufficient stability of the indentations during a molding process as to enable the indentations to maintain their shape for the otherwise useful life of the garment.

What is claimed is:

1. A garment having indentations shaped so as to define air channels next to the body of the wearer of the garment, wherein the garment comprises:

(a) a first yarn providing sufficient rigidity to define and maintain the shape of the indentations after the forming thereof;

(b) a second yarn; and (c) a third yarn comprising an elastomeric yarn providing sufficient stretch and recovery to enable a proper fit of the garment next to the body of the wearer.

2. The garment of claim 1, wherein the first yarn consists of a single monofilament of polyester.

3. The garment of claim 1, wherein the second yarn is formed from staple or filament yarn such as polyester, cotton, rayon, nylon, and/or acrylic.

4. The garment of claim 1, wherein the third yarn provides elasticity of the garment for comfort form fitting of the garment to the body of the wearer.

5. The garment of claim 4, wherein the third yarn comprises spandex.

6. The garment of claim 1, wherein the first yarn provides sufficient rigidity that a force of impact is absorbed upon compression of the indentations.

7. The garment of claim 1, wherein the second yarn is formed from staples of synthetic materials such as Kevlar, Nomex, or Spectra.

8. The garment of claim 1, wherein the indentations are uniform.

9. A combination of an outer garment and an undergarment, comprising:

(a) an outer garment; and (b) an undergarment having indentations shaped so as to define air channels next to the body of the wearer of the undergarment, the undergarment comprising, (i) a first yarn providing sufficient rigidity to define and maintain the shape of the indentations after the forming thereof, (ii) a second yarn, and (iii) a third yarn comprising an elastomeric yarn providing sufficient stretch and recovery to enable a proper fit of the undergarment next to the body of the wearer.

10. The combination of an outer garment and an undergarment of claim 9, wherein the outer garment comprises protective equipment.

11. The combination of an outer garment and an undergarment of claim 9, wherein the outer garment comprises a bulletproof vest.

12. The combination of an outer garment and an undergarment of claim 9, wherein the outer garment comprises battle gear for military use.

13. The combination of an outer garment and an undergarment of claim 9, wherein the outer garment comprise protective gear for athletic or sporting use.

14. The combination of an outer garment and an undergarment of claim 9, wherein the outer garment includes a vent.

15. The combination of an outer garment and an undergarment of claim 14, wherein the vent is adjustable for selectively admitting airflow to the undergarment.

16. The combination of an outer garment and an undergarment of claim 15, wherein the vent overlies indentations in the undergarment.

17. The combination of an outer garment and an undergarment of claim 9, wherein the outer garment is wind resistant or wind proof.

18. The combination of an outer garment and an undergarment of claim 9, wherein the outer garment includes a port and further comprising a conduit connected to the port supplying cool air to the air channels of the undergarment.

19. The garment of claim 1, wherein the second yarn provides fire retardence to the garment and is cut resistant.

20. A garment having indentations shaped so as to define air channels next to the body of the wearer of the garment, wherein the garment comprises:

(a) a first yarn providing sufficient rigidity to define and maintain the shape of the indentations after the forming thereof;

(b) a second yarn providing fire retardence to the garment; and (c) a third yarn comprising an elastomeric yarn providing sufficient stretch and recovery to enable a proper fit of the garment next to the body of the wearer.

* * * * *